US006601249B2

(12) United States Patent
Arnold et al.

(10) Patent No.: US 6,601,249 B2
(45) Date of Patent: Aug. 5, 2003

(54) SPRING PRE-ASSEMBLY FOR A MATTRESS FOUNDATION UNIT

(75) Inventors: Wayne Arnold, Gauteng (ZA); Graham Colman, Gauteng (ZA); Gianni Nosenzo, Gauteng (ZA)

(73) Assignee: International Wire Converters (Pty) Ltd, Gauteng (ZA)

( * ) Notice: Subject to any disclaimer, the term of this patent is extended or adjusted under 35 U.S.C. 154(b) by 81 days.

(21) Appl. No.: 09/976,419

(22) Filed: Oct. 12, 2001

(65) Prior Publication Data

US 2003/0070231 A1 Apr. 17, 2003

(51) Int. Cl.[7] ..... F16F 3/00
(52) U.S. Cl. ..... 5/247; 5/246; 5/255
(58) Field of Search ..... 5/247, 246, 255; 267/103, 165, 105, 106

(56) References Cited

U.S. PATENT DOCUMENTS

| | | | |
|---|---|---|---|
| 4,760,616 | A | 8/1988 | Hiatt et al. |
| 4,862,531 | A | 9/1989 | Wells |
| 4,862,532 | A | 9/1989 | Wells et al. |
| 4,891,853 | A | 1/1990 | Dabney |
| 4,932,535 | A | 6/1990 | Dabney |
| 5,142,715 | A | 9/1992 | Ogle |
| 5,142,716 | A | 9/1992 | Ogle |
| 5,152,509 | A | 10/1992 | Wells |
| 5,178,372 | A | 1/1993 | Rodgers et al. |
| 5,197,155 | A | 3/1993 | Ogle et al. |
| 5,346,190 | A | 9/1994 | Dabney |
| 5,369,822 | A | 12/1994 | Dennison |
| 5,438,716 | A | 8/1995 | Dabney |
| 5,558,315 | A | 9/1996 | Constantinescu et al. |
| 5,964,453 | A | 10/1999 | McCraw |

*Primary Examiner*—Teri Pham Luu
*Assistant Examiner*—Fredrick Conley
(74) *Attorney, Agent, or Firm*—Wood, Phillips, Katz, Clark & Mortimer

(57) ABSTRACT

The invention relates to a spring pre-assembly for a mattress foundation unit having a wooden base, a plurality of spring units and a mattress supporting wire grid that is supported above the wooden base by the spring units. The spring pre-assembly comprises a plurality of spring units connected to a wire grid consisting of a plurality of grid wire pairs arranged orthogonally to one another. The spring units include a base portion, a pair of divergently extending leg portions and a pair of engagement portions extending in opposite directions from the distal ends of the leg portions. The engagement portions can be engaged with adjacent grid wire pairs, the resulting arrangement being such that the spring units are pre-stressed.

18 Claims, 3 Drawing Sheets

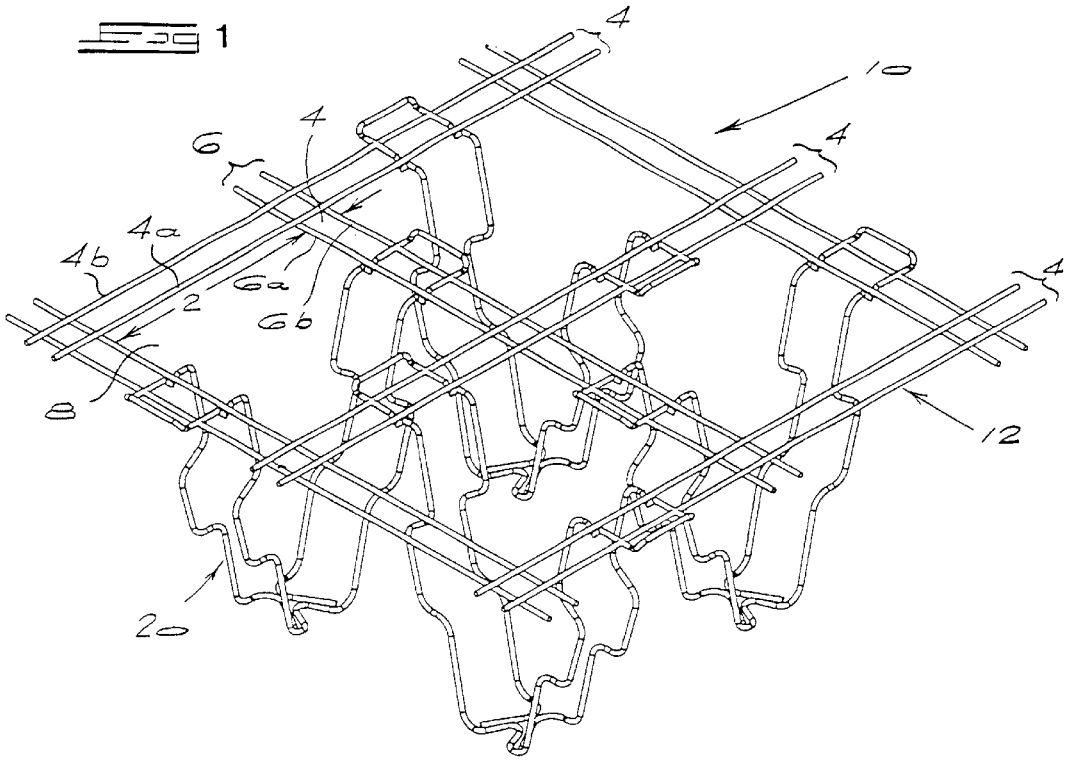
1
4
10
4
6
4
4a
4b
6a
6b
2
4
8
12
20
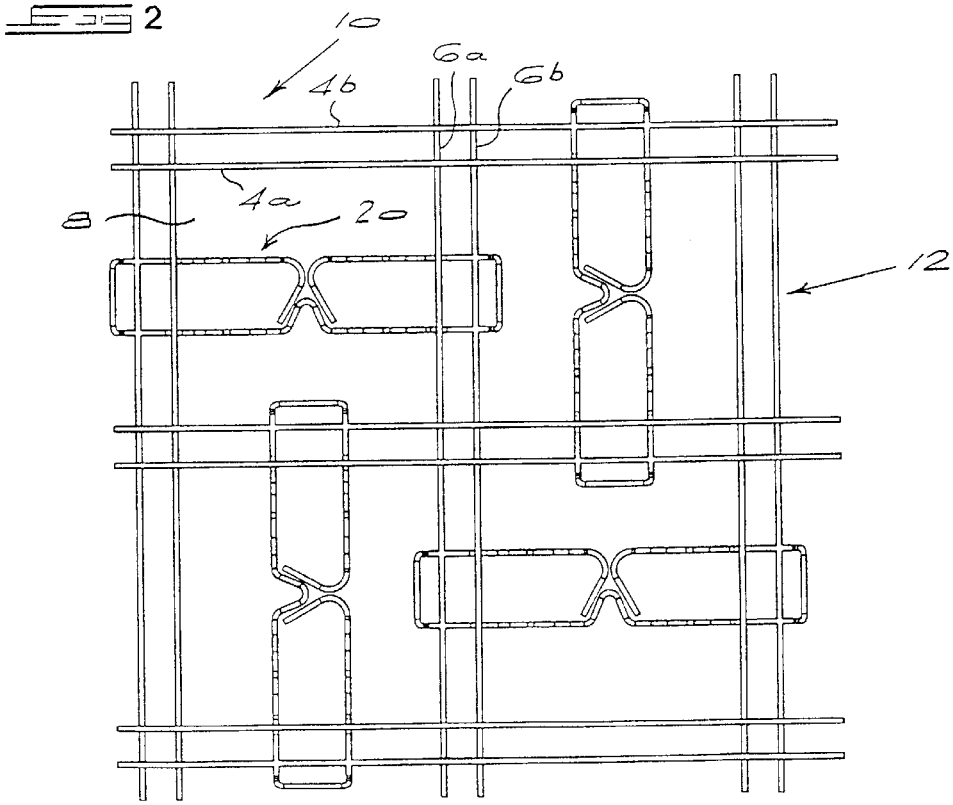
2
10
6a
6b
4b
4a
8
20
12

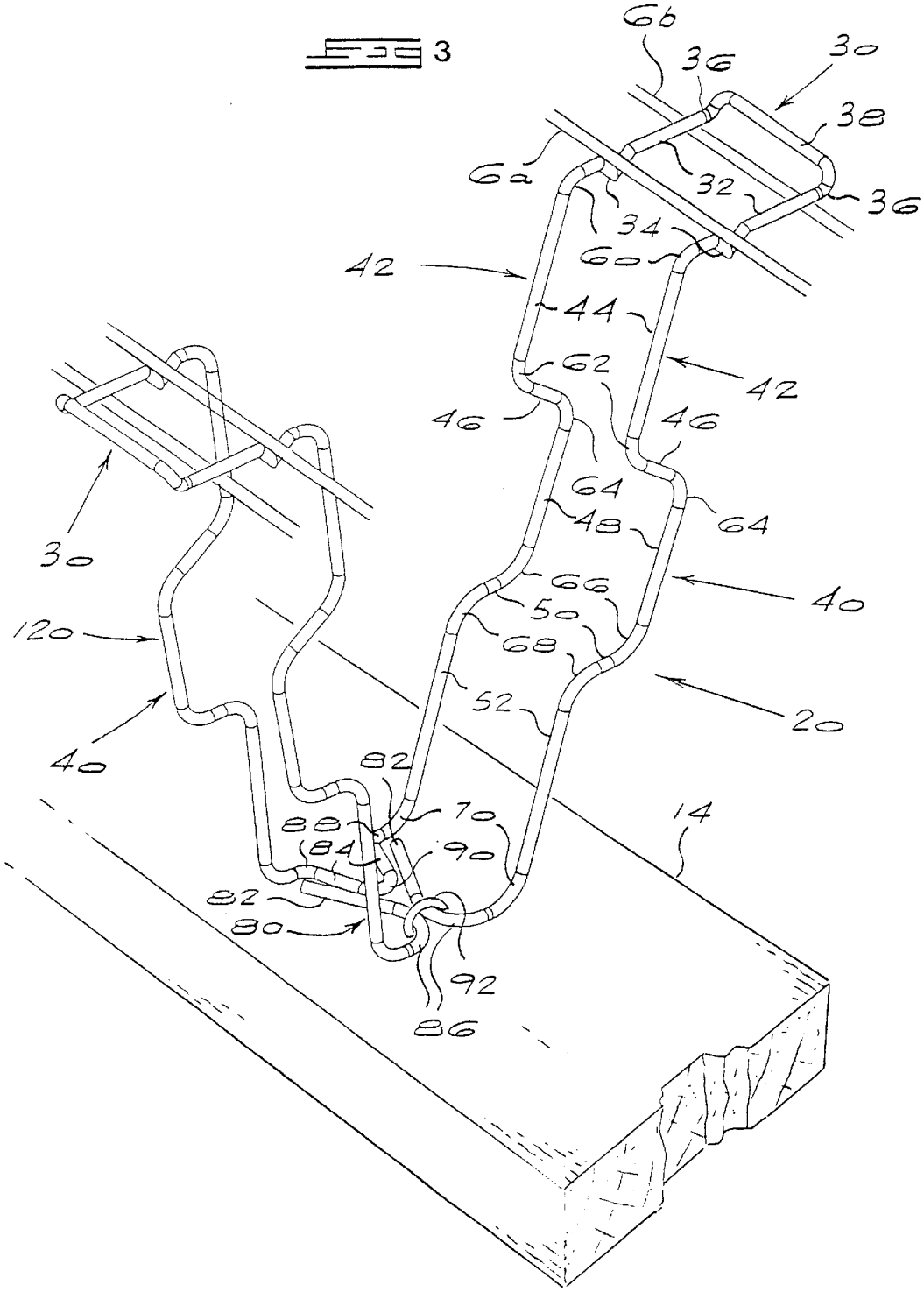
3
6b
36
30
38
6a
32
36
34
60
42
44
62
42
46
46
64
48
64
30
66
40
50
120
68
52
20
40
82
70
14
88
84
90
82
80
92
86

SPRING PRE-ASSEMBLY FOR A MATTRESS FOUNDATION UNIT

BACKGROUND TO THE INVENTION

THIS invention relates to a spring pre-assembly for a mattress foundation unit.

A conventional mattress foundation unit, sometimes referred to as a "box spring", generally includes a wooden base frame, spring modules and a mattress supporting wire grid that is supported above the wooden base frame by the spring modules. Whereas the spring modules are normally stapled to the wooden base frame below, various methods are used to secure the spring modules to the wire grid.

One method of securing the spring modules to the wire grid without the use of clips or welding is disclosed in U.S. Pat. No. 5,369,822, which is the use of downwardly extending and converging locking bars. Another method is disclosed in U.S. Pat. No. 5,197,155 and U.S. Pat. No. 5,142,716, wherein the top section of the spring module is being held in place by three grid wires extending over the top section and one grid wire extending under the top section.

Often, the wire grid and spring modules are manufactured and pre-assembled by a first manufacturer before being transported to a second manufacturer. The second manufacturer will typically complete the final mattress foundation unit by connecting the pre-assembly to the wooden base frame and applying the padding and covering. The ease of assembly and stackability of the pre-assembly are important design criteria for the first manufacturer.

SUMMARY OF THE INVENTION

According to a first aspect of the invention there is provided a spring pre-assembly for a mattress foundation unit having a rigid base, the spring pre-assembly including:

a plurality of spring units, each including a base portion, a pair of divergent, operatively upwardly extending leg portions and a pair of engagement portions extending at a generally horizontal attitude in opposite directions from operatively upper ends of the leg portions; and an upper grid which includes a plurality of grid wire pairs arranged orthogonally to one another, each grid wire pair comprising a first grid wire and a second grid wire;

the base portions of the spring units being connectable to the rigid base and the engagement portions of the spring units being engageable with adjacent grid wire pairs of the upper grid, the arrangement being such that when the engagement portions are so engaged the spring units are pre-stressed.

Advantageously, the spring unit is formed from a single length of wire.

Ideally, each engagement portion includes two spaced apart straight wire sections, each straight wire section having a notch receiving the first grid wire and each straight wire section passing over the second grid wire, thereby to secure the engagement portion with the grid wire pair.

Preferably, each leg portion includes two spaced apart spring members. More preferably, each spring member has a U-shaped deformity therein. Most preferably, each spring member lies generally in a single plane and includes five straight wire sections extending between each engagement portion and the base portion and at least one bend between the straight wire sections.

Advantageously, the spring unit is symmetrical about an operatively vertical plane bisecting the base portion.

According to a second aspect of the invention there is provided a spring unit for a mattress foundation unit having a wire grid, a rigid base and a plurality of spring units extending between the wire grid and the rigid base, each spring unit including:

a base portion, a pair of leg portions divergently extending from the base portion and a pair of engagement portions extending in opposite directions from the distal ends of the leg portions;

the base portion being connectable to the rigid base;

the leg portions each having a U-shaped deformity; and the engagement portions being generally co-planar with one another and each including a notch therein.

According to a third aspect of the invention there is provided a mattress foundation unit including:

a rigid base;

a plurality of spring units, each including a base portion, a pair of divergent, operatively upwardly extending leg portions and a pair of engagement portions extending at a generally horizontal attitude in opposite directions from operatively upper ends of the leg portions; and an upper grid which includes a plurality of grid wire pairs arranged orthogonally to one another, each grid wire pair comprising a first grid wire and a second grid wire;

the base portions of the spring units being connectable to the rigid base and the engagement portions of the spring units being engageable with adjacent grid wire pairs of the upper grid, the arrangement being such that when the engagement portions are so engaged the spring units are pre-stressed.

BRIEF DESCRIPTION OF THE DRAWINGS

The invention will now be described in more detail, by way of example only, with reference to the accompanying drawings in which:

FIG. 1 shows a perspective view of a spring pre-assembly according to the present invention;

FIG. 2 shows a top view of the spring pre-assembly illustrated in FIG. 1;

FIG. 3 shows a perspective view of a spring unit for the spring pre-assembly illustrated in FIG. 1.

DESCRIPTION OF AN EMBODIMENT

Figure 4:
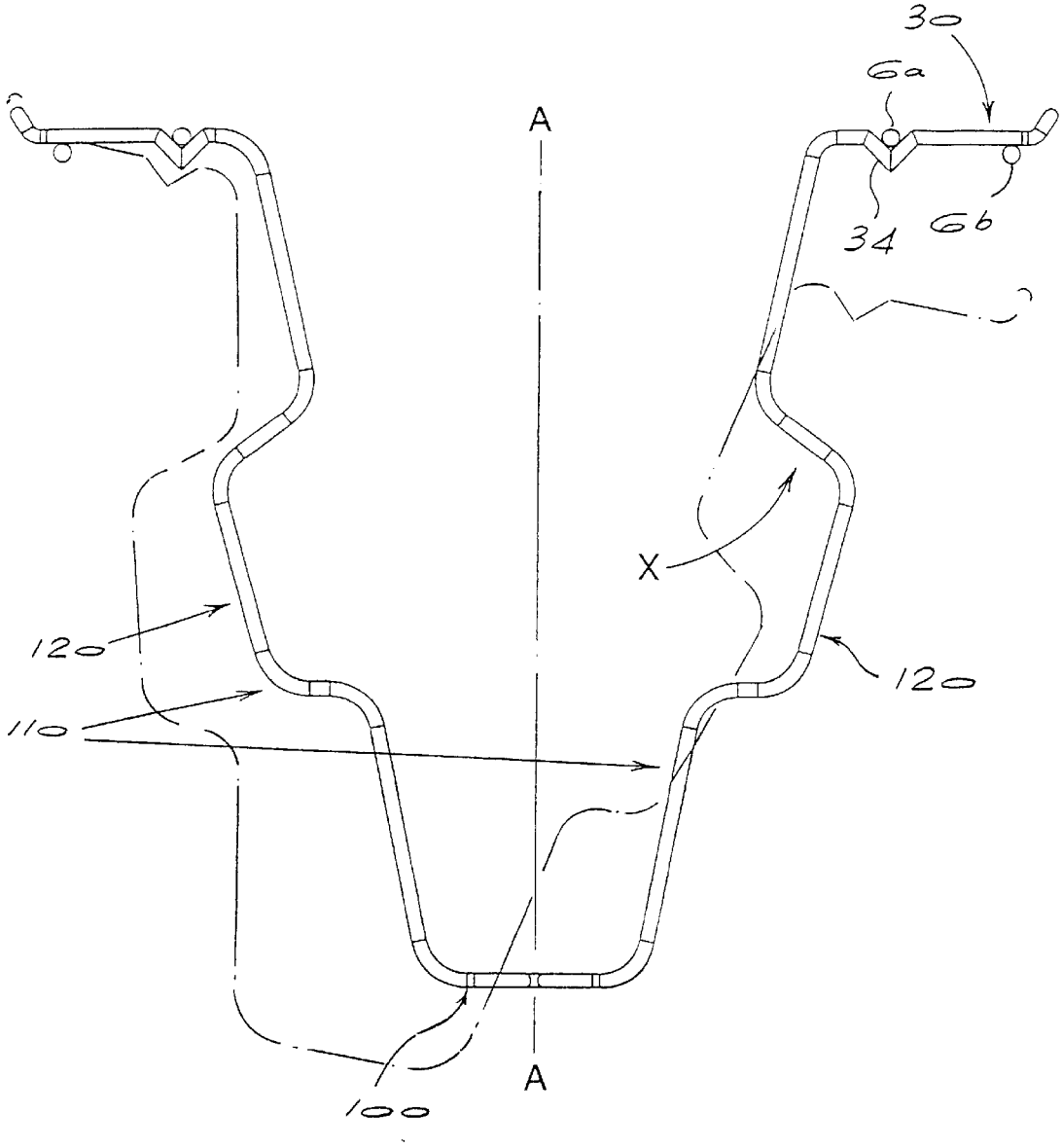
FIG. 4 shows a front view of the spring unit.

The spring pre-assembly 10 in FIG. 1 includes a wire grid 12 and a plurality of spring units 20 secured with the wire grid 12.

The wire grid 12 comprises a first plurality of spaced parallel grid wire pairs 4 that orthogonally intersects a second plurality of spaced parallel grid wire pairs 6. The first plurality of grid wire pairs and second plurality of grid wire pairs are welded together at the intersections to form a welded wire grid. A grid wire pair 6 comprises a first grid wire 6*a* and a second grid wire 6*b*. A spacing 2 between any successive grid wire pairs is predetermined to be greater than a spacing 4 between the first grid wire 6*a* and the second grid wire 6*b* of a grid wire pair 6. The wire grid defines an array of rectangular pockets 8. A typical rectangular pocket is bordered by grid wire pairs 4 and 6.

As shown in FIG. 3, the spring unit 20 is made of a single length of conventional spring steel wire to provide a base portion 80, a pair of leg portions 40 and a pair of engagement portions 30 extending at generally horizontal attitude in opposite directions from the operatively upper ends of the leg portions. As illustrated in FIG. 4, the spring unit 20 is formed to be generally U-shaped with the closed end 100 representing the base portion 80 and the free ends 110 representing the leg portions 40, each free end 110 terminating in an engagement portion 30. The spring unit is symmetrical about plane A—A in FIG. 4.

The engagement portion 30 is interlockingly engageable with a transversing grid wire pair and includes two parallel spaced apart straight wire sections 32. Each straight wire section 32 has a V-shaped notch 34 to receive the first grid wire 6*a* of the grid wire pair. The second grid wire 6*b* of the grid wire pair abuts the opposite side of the straight wire section. The distal end of the straight wire section terminates in an upward bend 36, with a cross bar 38 extending between the upward bends 36 of adjacent straight wire sections 32.

The leg portions 40 diverge upwardly from the base portion 80. The engagement portions 30 are connected to the leg portions 40 by bends 60. Each leg portion is a mirror image of the other leg portion. Each leg portion comprises two parallel spaced spring members 42. Each spring member 42 includes five coplanar straight wire sections that are interlinked by bends. A first straight wire section 44 extends downwardly from a bend 60 and is connected to a second straight wire section 46 by a bend 62. The second straight wire section 46 extends outwardly relative to the first straight wire section and is connected to a third straight wire section 48 by a bend 64. The third straight wire section 48 extends downwardly and is connected to a fourth straight wire section 50 by a bend 66. The fourth straight wire section 50 extends inwardly relative to the third straight wire section 48 and is interconnected to a downwardly extending fifth straight wire section 52 by a bend 68. The specific configuration of the straight wire sections and interlinking bends provides a U-shaped deformity 120 in the spring member 42. It is the presence of the U-shaped deformity that contributes to the spring member's ability to deform resiliently when a load is applied to the top of the spring pre-assembly.

The leg portion 40 is connected to the base portion 80 by bends 70. The base portion includes a combination of straight wire sections 82 and 84 and bends 86, 88 and 90. The straight wire sections and the bends of the base portion are formed to be coplanar to each other.

In order to secure a spring unit to the wire grid, an engagement portion 30 is inserted between the grid wires of a grid wire pair as illustrated by the chain dotted line in FIG. 4 and the spring unit is rotated in direction X so as to clip a grid wire into the V-shaped notch of the engagement portion. The leg portions and engagement portions are able to deform resiliently to allow the other engagement portion of the spring unit to be inserted between the grid wires of the adjacent grid wire pair. It will be appreciated that the upward bends 36 at the distal end of the engagement portion will assist with the insertion of the other engagement portion. The spring unit is interlockingly secured when the first grid wire of the grid wire pair clips into the V-shaped notch of the engagement portion and the second grid wire of the grid wire pair abuts the other side of the engagement portion. The spring unit is pre-stressed in the secured position.

As shown in FIG. 2, each spring unit 20 is secured within a single and separate rectangular pocket 8. The springs units that are secured within adjacent rectangular pockets are perpendicularly oriented to one another.

In order to assemble a mattress foundation unit, the pre-assembly 10 is connected to slats 14 of a conventional wooden base frame by staples 92 before applying the padding and covering. Accept for the unique spring pre-assembly, the mattress foundation unit is conventional and the complete unit is not illustrated in any figure.

An important advantage of the spring unit according to the present invention resides in the fact that the spring unit is pre-stressed in the secured position. This feature neutralizes a portion of a load that is applied to the mattress foundation unit containing the unique spring unit. This implies that the unique spring unit will experience less stress than a spring unit according to the prior art, when similar loads are applied to the respective mattress foundation units containing the spring units.

We claim:

1. A spring pre-assembly for a mattress foundation unit having a rigid base, the spring pre-assembly including:

a plurality of spring units, each including a base portion, a pair of divergent, operatively upwardly extending leg portions and a pair of engagement portions extending at a generally horizontal attitude in opposite directions from operatively upper ends of the leg portions; and an upper grid which includes a plurality of grid wire pairs arranged orthogonally to one another, each grid wire pair comprising a first grid wire and a second grid wire;

the base portions of the spring units being connectable to the rigid base and the engagement portions of the spring units being engageable with adjacent grid wire pairs of the upper grid, the arrangement being such that when the engagement portions are so engaged the spring units are pre-stressed.

2. A spring pre-assembly according to claim 1, wherein each engagement portion includes two spaced apart straight wire sections, each straight wire section having a notch receiving the first grid wire and each straight wire section passing over the second grid wire, thereby to secure the engagement portion with the grid wire pair.

3. A spring pre-assembly according to claim 1, wherein each leg portion includes two spaced apart spring members.

4. A spring pre-assembly according to claim 3, wherein each spring member lies generally in a single plane and includes five straight wire sections extending between each engagement portion and the base portion and at least one bend between the straight wire sections.

5. A spring pre-assembly according to claim 4, wherein the spring unit is symmetrical about an operatively vertical plane bisecting the base portion.

6. A spring pre-assembly according to claim 5, wherein the spring unit is formed from a single length of wire.

7. A spring unit for a mattress foundation unit having a wire grid, a rigid base and a plurality of spring units extending between the wire grid and the rigid base, each spring unit including:

a base portion, a pair of leg portions divergently extending from the base portion and a pair of engagement portions extending in opposite directions from the distal ends of the leg portions;

the base portion being connectable to the rigid base;

the leg portions each having a U-shaped deformity; and the engagement portions being generally co-planar with one another and each including a notch therein.

8. A spring unit according to claim 7, wherein each engagement portion includes two spaced apart straight wire sections, each straight wire section having a notch therein.

9. A spring unit according to claim 7, wherein each leg portion includes two spaced apart spring members, each spring member having a U-shaped deformity therein.

10. A spring unit according to claim 9, wherein each spring member lies generally in a single plane and includes five straight wire sections extending between each engagement portion and the base portion and at least one bend between the straight wire sections.

11. A spring unit according to claim 10, wherein the spring unit is symmetrical about an operatively vertical plane bisecting the base portion.

12. A spring unit according to claim 11, wherein the spring unit is formed from a single length of wire.

13. A mattress foundation unit including:

a rigid base;

a plurality of spring units, each including a base portion, a pair of divergent, operatively upwardly extending leg portions and a pair of engagement portions extending at a generally horizontal attitude in opposite directions from operatively upper ends of the leg portions; and an upper grid which includes a plurality of grid wire pairs arranged orthogonally to one another, each grid wire pair comprising a first grid wire and a second grid wire;

the base portions of the spring units being connectable to the rigid base and the engagement portions of the spring units being engageable with adjacent grid wire pairs of the upper grid, the arrangement being such that when the engagement portions are so engaged the spring units are pre-stressed.

14. A mattress foundation unit according to claim 13, wherein each engagement portion includes two spaced apart straight wire sections, each straight wire section having a notch receiving the first grid wire and each straight wire section passing over the second grid wire, thereby to secure the engagement portion with the grid wire pair.

15. A mattress foundation unit according to claim 13, wherein each leg portion includes two spaced apart spring members.

16. A mattress foundation unit according to claim 15, wherein each spring member lies generally in a single plane and includes five straight wire sections extending between each engagement portion and the base portion and at least one bend between the straight wire sections.

17. A mattress foundation unit according to claim 16, wherein the spring unit is symmetrical about an operatively vertical plane bisecting the base portion.

18. A mattress foundation unit according to claim 17, wherein the spring unit is formed from a single length of wire.

* * * * *